US012498163B2

(12) United States Patent
Thomas et al.

(10) Patent No.: US 12,498,163 B2
(45) Date of Patent: Dec. 16, 2025

(54) REFRIGERATION APPLIANCE AND METHOD FOR THREE-COMPARTMENT COOLING

(71) Applicant: Haier US Appliance Solutions, Inc., Wilmington, DE (US)

(72) Inventors: Ryan Joseph Thomas, Louisville, KY (US); Carlos Gonzalez Juarez, Louisville, KY (US); Joseph Thomas Waugh, Louisville, KY (US)

(73) Assignee: Haier US Appliance Solutions, Inc., Wilmington, DE (US)

( * ) Notice: Subject to any disclaimer, the term of this patent is extended or adjusted under 35 U.S.C. 154(b) by 269 days.

(21) Appl. No.: 18/297,972

(22) Filed: Apr. 10, 2023

(65) Prior Publication Data

US 2024/0337430 A1 Oct. 10, 2024

(51) Int. Cl.
*F25D 17/06* (2006.01)
*F25D 11/02* (2006.01)

(52) U.S. Cl.
CPC ..... *F25D 17/065* (2013.01); *F25D 11/02* (2013.01)

(58) Field of Classification Search
CPC ..... F25D 13/04; F25D 11/02
See application file for complete search history.

(56) References Cited

U.S. PATENT DOCUMENTS

| | | | | |
|---|---|---|---|---|
| 6,725,680 | B1 | 4/2004 | Schenk et al. | |
| 6,779,353 | B2 | 8/2004 | Hu | |
| 7,100,387 | B2 | 9/2006 | Boer et al. | |
| 8,181,472 | B2 | 5/2012 | Schenk et al. | |
| 9,016,077 | B2 | 4/2015 | Cho et al. | |
| 11,105,549 | B2 | 8/2021 | Brooke et al. | |
| 2007/0137230 | A1* | 6/2007 | Bae | F25D 11/022 62/526 |
| 2008/0289354 | A1* | 11/2008 | Dudley | F25B 5/02 62/115 |
| 2013/0061620 | A1 | 3/2013 | Li | |
| 2020/0300530 | A1* | 9/2020 | Kim | F25D 17/08 |

* cited by examiner

*Primary Examiner* — Elizabeth J Martin
(74) *Attorney, Agent, or Firm* — Dority & Manning, P.A.

(57) ABSTRACT

A refrigeration appliance, a controller, and a method for operating a three-compartment refrigeration appliance are provided. Operations include operating a cooling system to provide cooled air to a first compartment then operating the cooling system to provide cooled air to a second compartment. After operating the cooling system to provide cooled air to the second compartment, the operations include operating the cooling system to provide cooled air to the third compartment prior to deactivating the cooling system following operating the cooling system to provide cooled air to the second compartment.

20 Claims, 8 Drawing Sheets

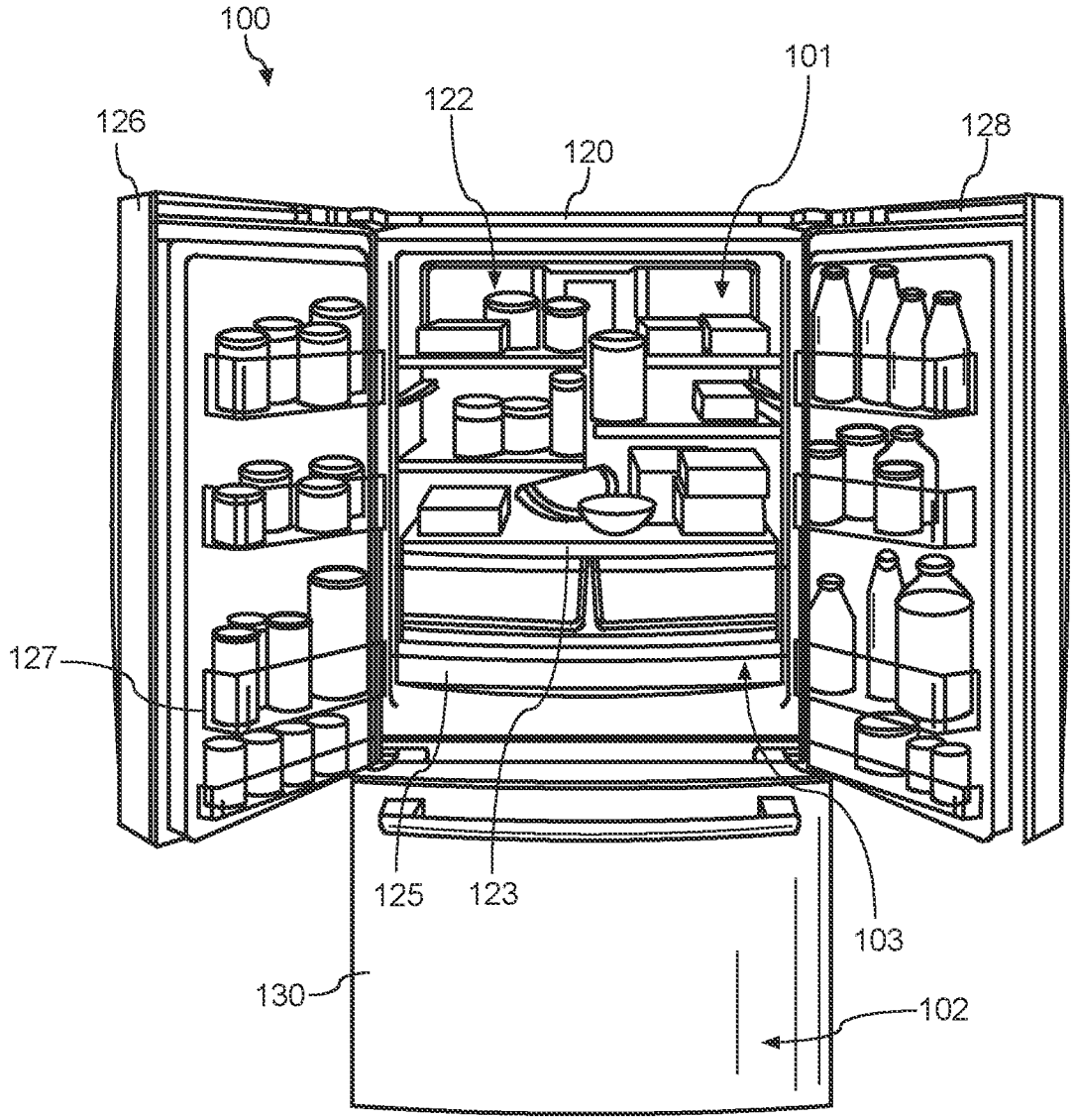
FIG, 2

600

| | FZ LowHyst | FZ HighHyst | FZ ExtraHigh | |
|---|---|---|---|---|
| DelayCcCooling=inactive<br>CoolCcBeforOFF=inactive<br>UseDelayedCcCoolingLowSpeed<br>=inactive | DelayCcCooling=inactive<br>CoolCcBeforOFF=inactive<br>UseDelayedCcCoolingLowSpeed<br>=inactive | DelayCcCooling=inactive<br>CoolCcBeforOFF=inactive<br>UseDelayedCcCoolingLowSpeed<br>=inactive | DelayCcCooling=inactive<br>CoolCcBeforOFF=inactive<br>UseDelayedCcCoolingLowSpeed<br>=inactive | |
| DelayCcCooling=inactive<br>CoolCcBeforOFF=inactive<br>UseDelayedCcCoolingLowSpeed<br>=inactive | DelayCcCooling=inactive<br>CoolCcBeforOFF=inactive<br>UseDelayedCcCoolingLowSpeed<br>=inactive | DelayCcCooling=inactive<br>CoolCcBeforOFF=inactive<br>UseDelayedCcCoolingLowSpeed<br>=inactive | DelayCcCooling=inactive<br>CoolCcBeforOFF=inactive<br>UseDelayedCcCoolingLowSpeed<br>=inactive | FZ<br>Superhigh |
| DelayCcCooling=inactive<br>CoolCcBeforOFF=inactive<br>UseDelayedCcCoolingLowSpeed<br>=inactive | DelayCcCooling=inactive<br>CoolCcBeforOFF=inactive<br>UseDelayedCcCoolingLowSpeed<br>=inactive | DelayCcCooling=inactive<br>CoolCcBeforOFF=inactive<br>UseDelayedCcCoolingLowSpeed<br>=inactive | DelayCcCooling=inactive<br>CoolCcBeforOFF=inactive<br>UseDelayedCcCoolingLowSpeed<br>=inactive | FZ<br>Extrahigh |
| DelayCcCooling=inactive<br>CoolCcBeforOFF=inactive<br>UseDelayedCcCoolingLowSpeed<br>=inactive | DelayCcCooling=inactive<br>CoolCcBeforOFF=inactive<br>UseDelayedCcCoolingLowSpeed<br>=inactive | DelayCcCooling=inactive<br>CoolCcBeforOFF=inactive<br>UseDelayedCcCoolingLowSpeed<br>=inactive | DelayCcCooling=inactive<br>CoolCcBeforOFF=inactive<br>UseDelayedCcCoolingLowSpeed<br>=inactive | FZ<br>HighHyst |
| DelayCcCooling=inactive<br>CoolCcBeforOFF=inactive<br>UseDelayedCcCoolingLowSpeed<br>=inactive | if(CompressorActualState=off)then<br>if(CoolCCBeforeOff=active)then<br>if(CDZ>=cdz_block4)then-if CDZ enters neutral mode<br>CoolCcBeforeOff=inactive<br>UseDelayedCcCoolingLowSpeed=inactive<br>end<br>end<br>else<br>UseDelayedCcCoolingLowSpeed=inactive<br>CoolCcBeforOff=inactive<br>end<br>DelayCcCooling=Active | DelayCcCooling=inactive<br>CoolCcBeforOFF=inactive<br>UseDelayedCcCoolingLowSpeed<br>=inactive | DelayCcCooling=inactive<br>CoolCcBeforOFF=inactive<br>UseDelayedCcCoolingLowSpeed<br>=inactive | FZ<br>Delta |
| if(CoolCcBeforeOff=active)then<br>if(CDZ<cdz_block4)then<br>CC Cooling=True<br>Use DelayedCcCoolingLowSpeed=<br>active else<br>CoolCcBeforeOff=inactive<br>UseDelayedCcCoolingLowSpeed=<br>inactive<br>end<br>End<br>if(CoolCcBeforeOff=inactive)then<br>CC Cooling=False<br>UseDelayedCcCoolingLowSpeed=<br>inactive<br>End<br>DelayCcCooling=inactive | if((DelayCcCooling=active) and (CDZ<cdz_block2)) then<br>CoolCcBeforeOff=active<br>end<br>DelayCcCooling=inactive<br>if(CoolCcBeforeOff=inactive) then<br>if(CDZ<cdz_block4)then<br>CC Cooling=True<br>UseDelayedCcCoolingLowSpeed=active<br>else<br>CoolCcBeforeOff=inactive<br>UseDelayedCcCoolingLowSpeed=inactive<br>end<br>End<br>if(CoolCcBefoeOff=inactive)then<br>CC Cooling=False<br>UseDelayedCcCoolingLowSpeed=inactive<br>End | DelayCcCooling=inactive<br>CoolCcBeforOFF=inactive<br>UseDelayedCcCoolingLowSpeed<br>=inactive | DelayCcCooling=inactive<br>CoolCcBeforOFF=inactive<br>UseDelayedCcCoolingLowSpeed<br>=inactive | FZ<br>LowHyst |

602

601

FIG. 6

700

| OC Temperature Sensor | CCZ |
|---|---|
| CC High Dead Band | **Block 0** TempControlMode=ActiveCooling<br>**{Zone 0}** |
| CC HDB & HH Average Line | **Block 1** if(CoolCcBeforeOff==active) OR<br>**{Zone 1}** ((CompressorActualState=off)AND<br>(DelayCcCooling==inactive)) then<br>TempControlMode=ActiveCooling |
| CC High Hystoresis | **Block 2** if(CoolCcBeforeOff==active) OR<br>**{Zone 2}** ((CompressorActualState=off)AND<br>(ValveActualState==B) AND<br>(DelayCcCooling==inactive)) then<br>TempControlMode=ActiveCooling |
| CC Adjusted Set Point | **Block 3** if(TempControlMode=ActiveHeating) then<br>**{Zone 2}** TempControlMode=Neutral |
| CC Low Hystoresis | **Block 4** ForceCdHeaterOn=inactive<br>**{Zone 3}** |
| CC Low Dead Band | **Block 5** if(TempControlMode==ActiveCooling) then<br>**{Zone 4}** TempControlMode=Neutral<br>if(TripleEvap==True) then<br>if(TempControlMode==ActiveHeating) then<br>TempControlMode=Neutral |
| CC Super Low Dead Band | **Block 6** TempControlMode=ActiveHeating<br>**{Zone 5}** |
| 701 | **Block 6** TempControlMode=ActiveHeating<br>**{Zone 5}** ForceCdHeaterOn=active |

FIG. 7

REFRIGERATION APPLIANCE AND METHOD FOR THREE-COMPARTMENT COOLING

FIELD

The present disclosure relates generally to refrigeration appliances. The present disclosure relates particularly to three-compartment refrigeration appliances and methods for operation thereof.

BACKGROUND

Refrigeration appliances may include a fresh food compartment, a freezer compartment, and a convertible compartment each having separate temperatures. However, temperatures at each compartment can experience inconsistent and unpredictable, or erratic, temperature cycling, such as due to interruptions in a cooling cycle for each compartment. Erratic temperature cycling can result in deterioration in appliance performance and variations in appliance-to-appliance performance. Additionally, or alternatively, erratic temperature cycling can result in undesirable magnitudes of temperature change, such as may adversely affect appliance performance or quality of foodstuffs at the compartments.

Accordingly, refrigeration appliances and methods for operation thereof that address one or more of these issues would be advantageous and desirable.

BRIEF DESCRIPTION

The present subject matter provides a refrigeration appliance including a cabinet defining a first compartment, a second compartment, and a third compartment each separately controllable to respective temperatures. A cooling system is configured to provided cooled air to a target temperature relative to each compartment. A controller is in operable communication with the cooling system to cause the cooling system to perform a cooling cycle. The operations of the cooling cycle include operating the cooling system to provide cooled air to the first compartment then operating the cooling system to provide cooled air to the second compartment. The operations include, after operating the cooling system to provide cooled air to the second compartment, operating the cooling system to provide cooled air to the third compartment prior to deactivating the cooling system following operating the cooling system to provide cooled air to the second compartment.

An aspect of the present disclosure is directed to a method for operating a three compartment refrigeration appliance. The method includes operating a cooling system to provide cooled air to a first compartment then operating the cooling system to provide cooled air to a second compartment; determining a third compartment cooling state; and operating the cooling system to provide cooled air to a third compartment when the third compartment cooling state is active after operating the cooling system to provide cooled air to the second compartment and prior to deactivating the cooling system following operating the cooling system to provide cooled air to the second compartment.

Another aspect of the present disclosure is directed to a controller for operating a refrigeration appliance. The controller is configured to cause a cooling system of the refrigeration appliance to perform a cooling cycle. The operations include determining whether first compartment cooling is demanded; commanding the cooling system to provide first compartment cooling when first compartment cooling is demanded and until a first compartment temperature is satisfied; commanding the cooling system to provide second compartment cooling after the first compartment temperature is satisfied and until a second compartment temperature is satisfied; and commanding the cooling system to provide cooled air to a third compartment.

Variations and modifications may be made to these example embodiments of the present disclosure. These and other features, aspects and advantages of the present invention will become better understood with reference to the following description and appended claims. The accompanying drawings, which are incorporated in and constitute a part of this specification, illustrate embodiments of the invention and, together with the description, serve to explain the principles of the invention.

BRIEF DESCRIPTION OF THE DRAWINGS

A full and enabling disclosure of the present invention, including the best mode thereof, directed to one of ordinary skill in the art, is set forth in the specification, which makes reference to the appended figures, in which:

FIG. 2 provides a front, elevation view of an interior of the refrigeration appliance according to example embodiment of the present disclosure;

FIG. 6 provides an exemplary two-dimensional logic grid for a first and second compartment for an embodiment of a method for operating a three-compartment refrigeration appliance in accordance with aspects of the present disclosure;

FIG. 7 provides an exemplary one-dimensional logic grid for a third compartment for an embodiment of a method for operating a three-compartment refrigeration appliance in accordance with aspects of the present disclosure.

DETAILED DESCRIPTION

Figure 1:
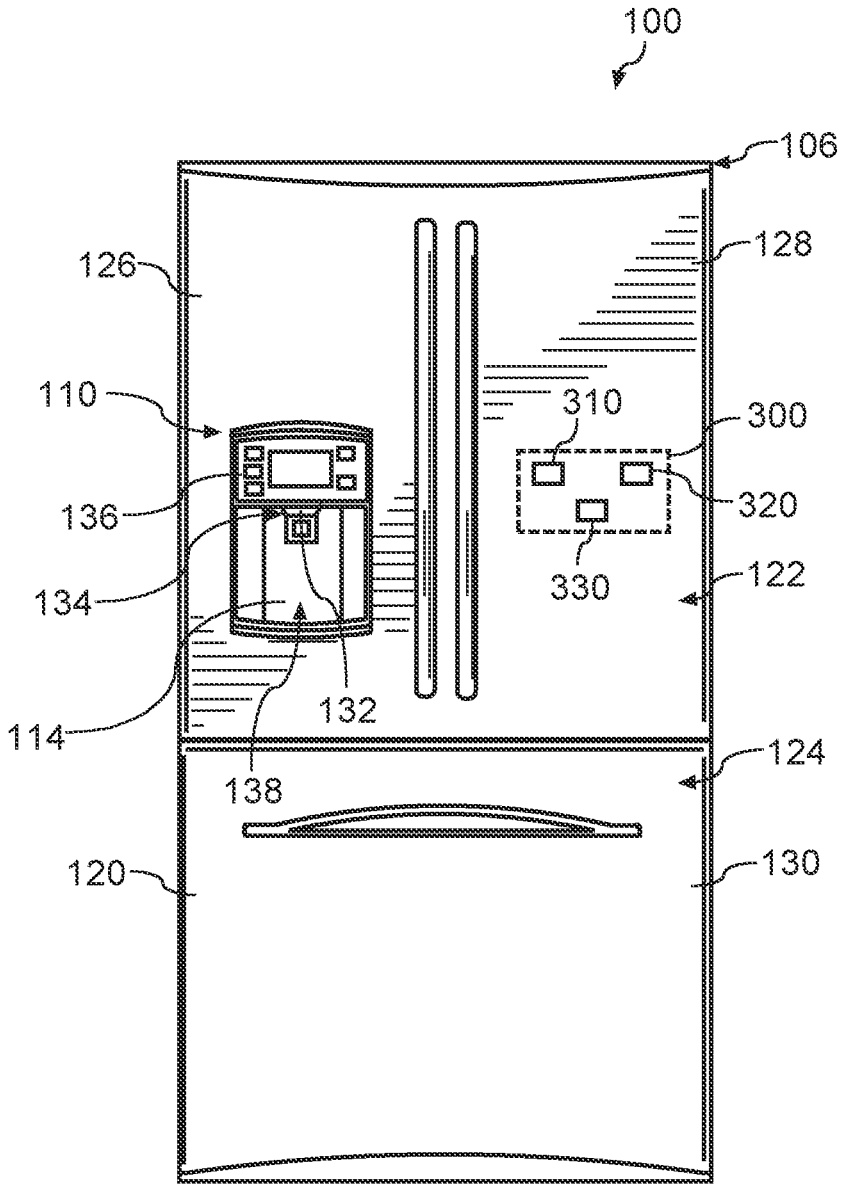
FIG. 1 provides a front, elevation view of a refrigeration appliance according to example embodiments of the present disclosure.

Reference now will be made in detail to embodiments of the invention, one or more examples of which are illustrated in the drawings. Each example is provided by way of explanation of the invention, not limitation of the invention. In fact, it will be apparent to those skilled in the art that various modifications and variations may be made in the present invention without departing from the scope or spirit of the invention. For instance, features illustrated or described as part of one embodiment may be used with another embodiment to yield a still further embodiment.

Thus, it is intended that the present invention covers such modifications and variations as come within the scope of the appended claims and their equivalents.

Referring now to the figures, FIG. 1 depicts a front view of an example embodiment of a refrigeration appliance 100. The appliance 100 may include a cabinet or housing 120 defining an upper refrigeration chamber 122 and a lower freezer chamber 124 arranged below the refrigeration chamber 122. As such, appliance 100 may generally be referred to as a bottom-mount refrigeration appliance. The refrigeration chamber 122 may form a main refrigeration or first compartment 101 (FIGS. 3A-3B) and freezer chamber 124 may form a second compartment 102, such as further described herein. A secondary refrigeration or third compartment 103 is further formed having a target temperature separate from the first and second compartments 101, 102. In the exemplary embodiment, housing 120 also defines a mechanical compartment (not shown) for receipt of a cooling system. Using the teachings disclosed herein, one of skill in the art will understand that the present disclosure may be used with other types of refrigeration-freezer appliances, such as, but not limited to, 3-door configurations, 4-door configurations, side-by-side configurations, top-bottom mount configurations, etc. Accordingly, the description set forth herein is for illustrative purposes only and is not intended to limit the invention to any particular style or arrangement of refrigeration or freezer appliance. For instance, a convertible compartment (e.g., third compartment) may be accessible from an exterior door separate from doors 126, 128.

Refrigerator doors 126, 128 are rotatably hinged to an edge of housing 120 for accessing refrigeration chamber 122. A freezer door 130 is arranged below refrigerator doors 126, 128 for accessing freezer chamber 124. In the exemplary embodiment, freezer door 130 is coupled to a freezer drawer (not shown) slidably mounted within freezer chamber 124.

Appliance 100 may include a dispensing assembly 110 for dispensing liquid water and ice. Dispensing assembly 110 includes a dispenser 114 positioned on an exterior portion of appliance 100. Dispenser 114 includes a discharging outlet 134 for accessing ice and liquid water. A user interface panel 136 is provided for controlling the mode of operation of the dispenser 114, such as for providing water, ice, or a type of type (e.g., crushed, non-crushed, cubed, clear, etc.).

Discharging outlet 134 is an external part of dispenser 114, and is mounted in a dispensing recess or recessed portion 138 defined in an outside surface of refrigerator door 126. Recessed portion 138 is positioned at a predetermined elevation convenient for a user to access ice or liquid water and enabling the user to access ice or liquid water without the need to bend-over and without the need to access freezer chamber 124. In the exemplary embodiment, recessed portion 138 is positioned at a level that approximates the chest level of a user. However, in other embodiments, the dispensing assembly 110 may be positioned within the appliance 100, such as within a chilled chamber thereof.

Operation of the appliance 100 is regulated by a control device or controller 300 that is operatively coupled to user interface panel 136, sensor 230, or both. The controller 300 may include one or more processors 314 and one or more memory devices 316. The one or more memory devices 316 may be configured to store instructions that, when executed by the one or more processors 314, causes the appliance 100 to perform operations such as provided below. The memory device(s) 316 may be configured to store data corresponding to one or more signals, functions, charts, tables, schedules, or determined values such as provided herein.

Panel 136 provides selections for user manipulation of the operation of appliance 100 such as e.g., selections between whole or crushed ice, chilled liquid water, or other options. In response to user manipulation of the user interface panel 136, the controller 300 operates various components of the appliance 100. The controller 300 may be positioned in a variety of locations throughout appliance 100. In the illustrated embodiment shown in FIG. 1, the controller 300 is located within or beneath the user interface panel 136 on door 126. In such an embodiment, input/output ("I/O") signals may be routed between controller 300 and various operational components of appliance 100. In one exemplary embodiment, the user interface panel 136 may represent a general purpose I/O ("GPIO") device or functional block. In another exemplary embodiment, the user interface 136 may include input components, such as one or more of a variety of electrical, mechanical or electro-mechanical input devices including rotary dials, push buttons, and touch pads. The user interface 136 may be in communication with the controller 300 via one or more signal lines or shared communication busses, such as described further herein.

Referring now to FIG. 2, a perspective view of an exemplary embodiment of the appliance 100 with doors 126, 128 open is provided, providing a view of an exemplary embodiment of an interior or refrigeration chamber 122. The refrigeration chamber 122 includes a plurality of shelves and drawers positioned within the refrigeration chamber 122. Shelves may include door-mounted shelves 127 positioned at one or both of doors 126, 128 and rack-mounted shelves 123 retained by an interior portion of the housing 120. Drawers 121 may be in sliding configuration and positioned below or between shelves 123. Shelves 123, 127 and drawers 121 are configured to hold, store, position, or otherwise retain foodstuffs upon surfaces at respective shelves 123, 127 or within compartments or volumes formed by drawers 121. One or more shelves may form a convertible compartment 125 at which the third compartment 103 is formed, such as described further herein.

As depicted schematically in FIG. 1, appliance 100 includes a controller 300. Controller 300 may include a memory device 310 (e.g., non-transitive storage media) and microprocessor 320, such as a general or special purpose microprocessor operable to execute programming instructions or micro-control code associated with a cleaning cycle. The memory device 310 may represent random access memory such as DRAM, or read only memory such as ROM or FLASH. In one embodiment, the processor executes programming instructions stored in memory. The memory device 310 may be a separate component from the processor or may be included onboard within the processor 320. Alternatively, controller 300 may be constructed without using a microprocessor, e.g., using a combination of discrete analog or digital logic circuitry (such as switches, amplifiers, integrators, comparators, flip-flops, AND gates, and the like) to perform control functionality instead of relying upon software.

It should be appreciated that communications busses 330 and secondary devices may correspond to any device that may be programmed to communicate controller 300 using one of Wi-Fi, Bluetooth®, ZigBee®, or similar type of wireless communications technologies and networks while running a program that provides for user input. In this context, devices such as, but not limited to, smartphones, tablet devices, and standalone devices may be used to implement the present subject matter.

Figure 3A:
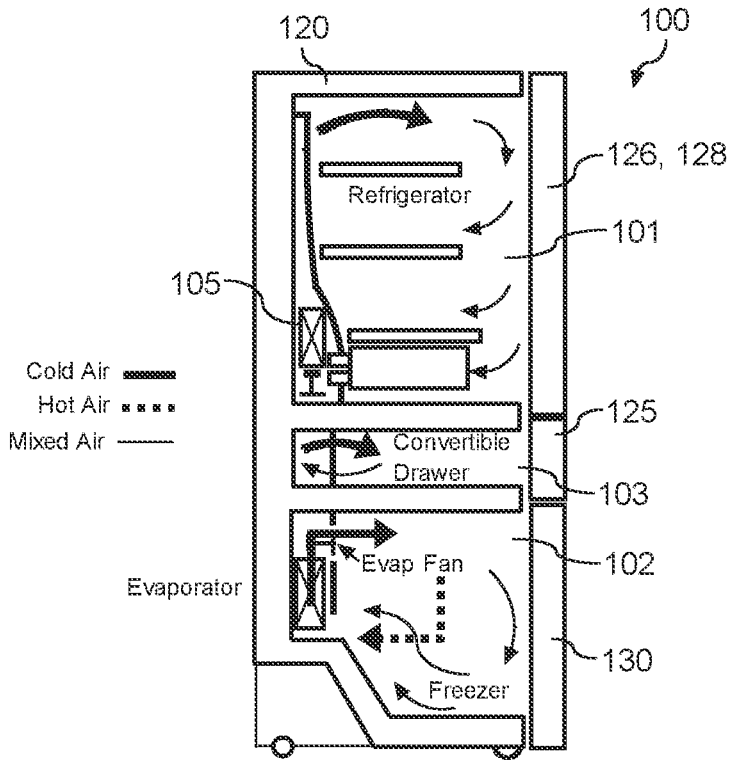
FIG. 3A provides a schematic side view of an interior of the refrigeration appliance according to example embodiment of the present disclosure.
Figure 3B:
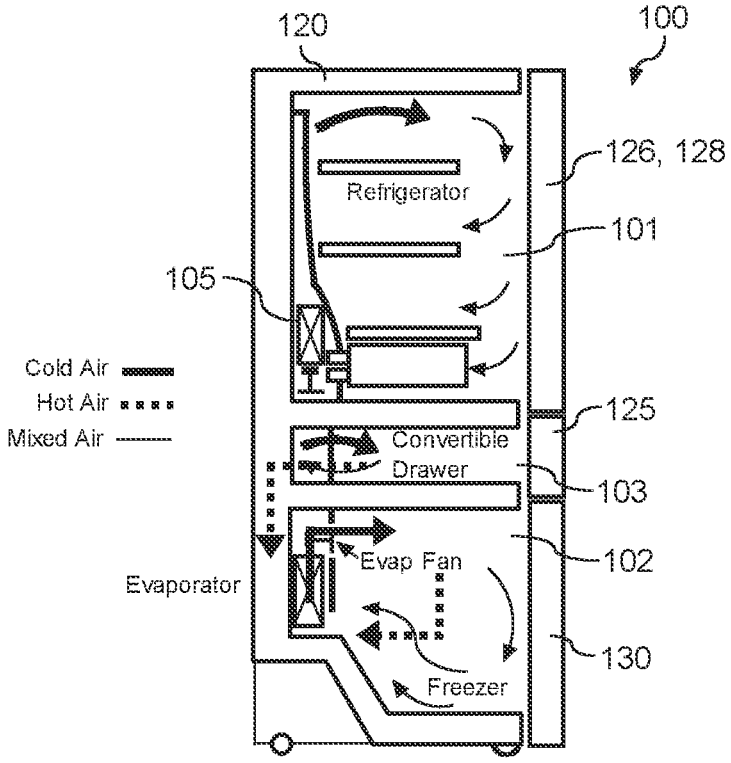
FIG. 3B provides a schematic side view of an interior of the refrigeration appliance according to example embodiment of the present disclosure.

FIGS. 3A-3B provide side cross sectional views of exemplary embodiments of an appliance 100. The appliance 100 is configured as a three-compartment refrigeration appliance including a first compartment 101, a second compartment 102, and a third compartment 103. The appliance 100 includes a cooling system 105, such as may include a compressor, an evaporator or condenser, fan, damper, sensors (e.g., temperature sensors, such as may correspond to each compartment 101, 102, 103) and other components as may be included in a cooling system for providing cooled air to a target temperature relative to each of the first compartment 101, the second compartment 102, and the third compartment 103 for a refrigeration and freezer appliance.

Figure 8:
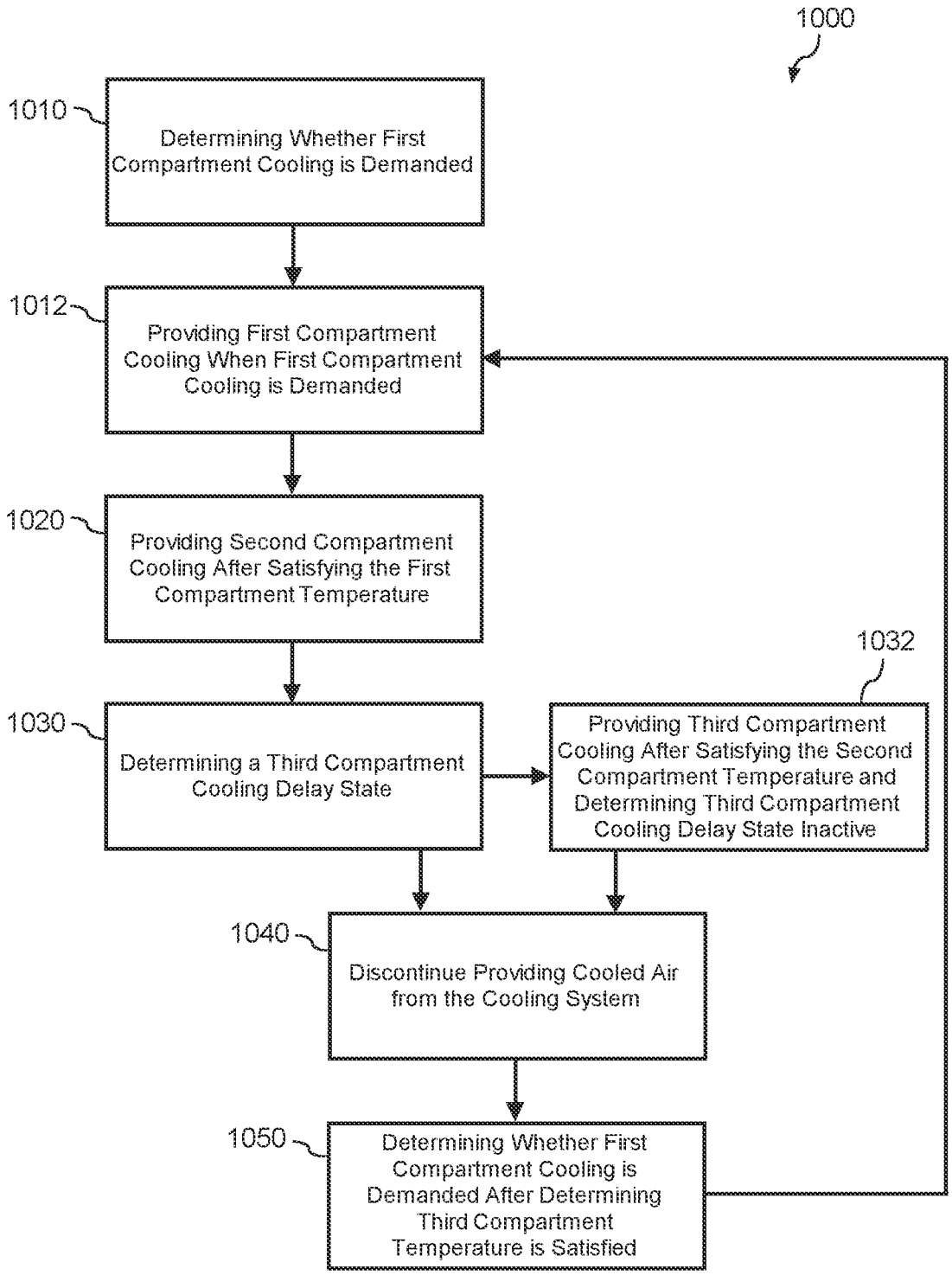
FIG. 8 illustrates a flowchart outlining steps of a method for three-compartment cooling of a refrigeration appliance in accordance with aspects of the present disclosure.

Referring now to FIG. 8, a flowchart outlining steps of a method for operating a three-compartment refrigeration appliance is provided (hereinafter, "method 1000"). Embodiments of the method allow for improved operation of a refrigeration appliance having a first compartment (i.e., a main refrigeration compartment, such as a fresh foods compartment), a second compartment (i.e., a freezer compartment), and third compartment (i.e., a secondary refrigeration compartment, such as a convertible compartment). Embodiments of the method 1000 may be stored or executed by embodiments of the appliance 100, such as via controller 300. However, it should be appreciated that embodiments of the method 1000 may be stored or executed by other configurations of refrigeration appliance including a first compartment, a second compartment, and a third compartment. For instance, steps of the method 1000 may be stored locally at the appliance or distributed over a computing network, such as at a remote server, at a local controller, or at a remote computing device, or combinations thereof.

Embodiments of the method 1000 provide a series control prioritizing a first compartment (FF) over a second compartment (FZ) over a third compartment (CC), allowing each compartment to be controlled by hysteresis lines rather than interaction from another compartment, such as to drive temperature stability and generate substantially repeatable or consistent cycles.

Figure 4:
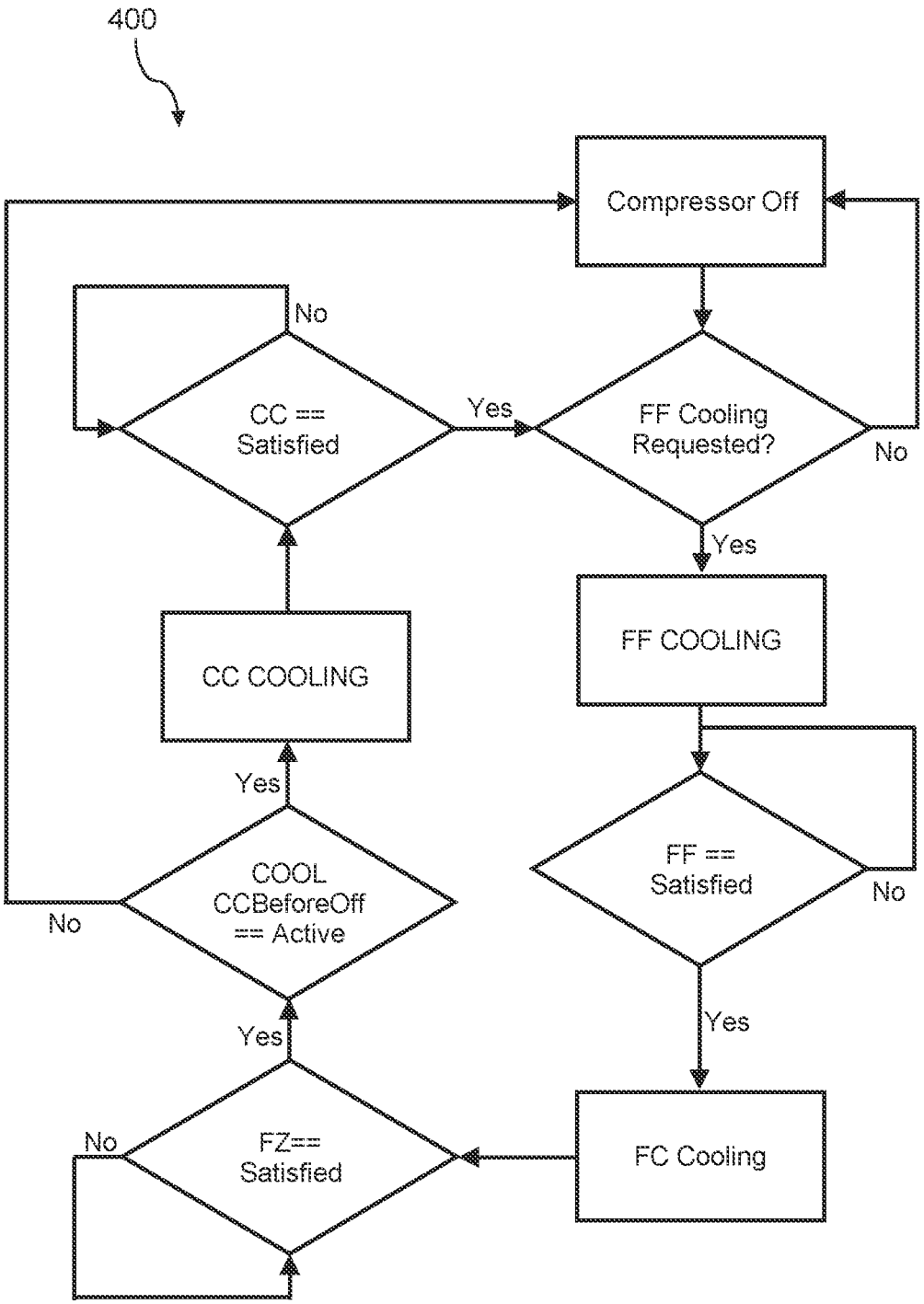
FIG. 4 provides an exemplary decision tree in accordance with embodiments of a method for operating a three-compartment refrigeration appliance in accordance with aspects of the present disclosure.

FIG. 8 depicts a flowchart outlining exemplary serial steps and decision trees of an embodiment of method 1000. FIG. 4 depicts an exemplary decision tree 400 in accordance with embodiments of method 1000. Referring to FIGS. 4 and 8, method 1000 includes at 1010 determining whether first compartment cooling (FF Cooling) is demanded, such as via a sensor (e.g., a temperature sensor, such as a thermocouple, thermistor, or other device configured to determine temperature) determining whether a first compartment temperature is within a desired first compartment threshold temperature. Method 1000 at 1012 activates first compartment cooling when first compartment cooling is demanded. Method 1000 at 1012 continues first compartment cooling until the first compartment temperature is satisfied (i.e., the first compartment temperature is within the desired first compartment threshold temperature, such as via obtaining a first temperature signal corresponding to the first compartment temperature).

Method 1000 includes at 1020 activates second compartment cooling (FZ Cooling) after satisfying the first compartment temperature. Method 1000 at 1020 continues second compartment cooling until the second compartment temperature is satisfied (i.e., the second compartment temperature is within a desired second compartment threshold temperature, such as via obtaining a second temperature signal corresponding to the second compartment temperature). Operating the cooling system to provide cooled air to the second compartment may be discontinued after the second compartment temperature is satisfied.

Method 1000 includes at 1030 determining whether a Cool Third Compartment Before Turning Off (Cool CC Before Off, or CC Cooling Routine) is active (e.g., determining a third compartment cooling state). When the CC Cooling Routine is inactive, the method 1000 at 1040 turns off or otherwise deactivates the compressor or other operable components of the cooling system (e.g., cooling system 105). When the CC Cooling Routine is active, method 1000 at 1032 activates third compartment cooling (CC Cooling) after satisfying the second compartment temperature. In some embodiments, method 1000 at 1032 includes operating the third compartment based at least on whether a Delay CC Cooling mode is active, such as outlined in decision tree 500. Delay CC Cooling inhibits activating CC Cooling prior to first compartment temperature and second compartment temperature being satisfied. For instance, when the first compartment and the second compartment are cooling, Delay CC Cooling will inhibit cooling at the third compartment until first and second compartment temperatures are satisfied.

Method 1000 at 1032 continues third compartment cooling until the third compartment temperature is satisfied (i.e., the third compartment temperature is within a desired third compartment threshold temperature, such as via obtaining a third temperature signal corresponding to the third compartment temperature).

Method 1000 includes at 1050 determining whether first compartment cooling (FF Cooling) is demanded (such as step 1010) after determining third compartment temperature is satisfied. Method 1000 at 1012 activates first compartment cooling when first compartment cooling is demanded, such as described above, and the control loop may iterate until the compressor is allowed to deactivate. When method 1000 at 1050 determines first compartment cooling is not demanded, the compressor or other operable components of the cooling system (e.g., cooling system 105) may deactivate (such as step 1040).

Referring now to FIG. 6, an exemplary two-dimensional logic control grid 600 for the first compartment (Fresh Food Compartment or FF) and the second compartment (Freezer Compartment or FZ) is provided. The grid 600 may be executable by controller 300 to dynamically control temperature at the respective compartments.

Control grid 600 includes a first axis 601 partitioned into a plurality of operating ranges of first compartment (FF) temperatures, and a second axis 602 partitioned into a plurality of operating ranges of second compartment (FZ) temperatures. For instance, in increasing order, first axis 601 includes partitions defined by a fresh food compartment lower target temperature (FF Low Hysteresis), a fresh food compartment upper target temperature (FF High Hysteresis), and a fresh food compartment alarm temperature (FF Extra High Hysteresis). A target temperature zone of the first compartment may be defined between fresh food compartment lower target temperature (FF Low Hysteresis) and fresh food compartment upper target temperature (FF High Hysteresis).

Second axis 602 of control grid 600 includes partitions defined by second compartment temperatures (FZ). For instance, in increasing order, axis 602 partitions include a lower freezer compartment target temperature (FZ Low Hysteresis), a freezer compartment upper target temperature (FZ High Hysteresis), an upper hysteresis freezer compartment temperature (FZ Extra High Hysteresis), and a freezer alarm temperature (FZ Super High Hysteresis). A target temperature zone of the second compartment or delta temperature zone (FZ Delta) may be defined between lower freezer compartment target temperature (FZ Low Hysteresis) and a freezer compartment upper target temperature (FZ High Hysteresis).

The partitions of the first and second axes 601, 602 define a plurality of states of the refrigerator, and each operating point of refrigeration appliance, as determined by respective temperatures of first and second compartments, is contained in one of the states of control grid 600. FIG. 6 provides an exemplary logic grid and it should be appreciated that further partitions and targets may be defined. Actual temperatures that define the above-described partitions of first axis 601 and second axis 602 may be modified based on configuration of the refrigeration appliance and compartment setpoints.

Referring now to FIG. 7, an exemplary one-dimensional logic control grid 700 for the third compartment (Convertible Compartment or CC) is provided. The grid 700 may be executable by controller 300 to dynamically control temperature at the third compartments.

Control grid 700 includes a first axis 701 partitioned into a plurality of operating ranges of third compartment (CC) temperatures. For instance, first axis 701 includes partitions defined by a convertible compartment lower target temperature (CC Low Hysteresis) and a convertible compartment upper target temperature (CC High Hysteresis). A target temperature zone of the third compartment (CC Adjusted Set Point) is defined between the CC Lower Hysteresis and the CC High Hysteresis). An upper temperature limit (CC High Dead Band) is defined greater than the CC High Hysteresis. An average temperature line is defined between the CC High Dead Band (HDB) and the CC High Hysteresis. A lower temperature limit (CC Low Dead Band) is defined below the CC Low Hysteresis. A lower extreme temperature limit (CC Super Low Dead Band) is defined below the CC Low Dead Band.

The partition of the first axis 701 defines a plurality of states or Convertible Compartment Zones (CCZ) of the refrigerator, and each operating point of refrigeration appliance, as determined by temperature of the third compartment, is contained in one of the states of control grid 700. For instance, control grid 700 includes a plurality of control blocks (e.g., Block 0, Block 1, . . . . Block 7) and a plurality of CCZ (e.g., Zone 1, Zone 2, . . . . Zone 5). For instance, in decreasing temperature, CCZ Zone 0 corresponds to a temperature greater than CC High Dead Band; CCZ Zone 1 corresponds to temperatures between the CC High Dead Band and CC High Hysteresis; CCZ Zone 2 corresponds to temperatures between the CC High Hysteresis and the CC Adjusted Set Point; CCZ Zone 3 corresponds to temperatures between the CC Adjusted Set Point and the CC Low Hysteresis; CCZ Zone 4 corresponds to temperatures between the CC Low Hysteresis and the CC Low Dead Band; and CCZ Zone 5 corresponds to temperatures below the CC Low Dead Band.

Each CC Zone includes a control algorithm (Control Block) including setting or rules for adjusting control parameters to drive the state of the refrigeration appliance to the desired CCZ and maintain the state at the desired CCZ. For instance, each control block may include a compressor parameter, an evaporator fan speed parameter, a damper parameter, a fan parameter, or combinations thereof.

FIG. 7 provides an exemplary logic grids and it should be appreciated that further partitions and targets may be defined. Actual temperatures that define the above-described partitions of axis 701 may be modified based on configuration of the refrigeration appliance and compartment setpoints.

Figure 5:
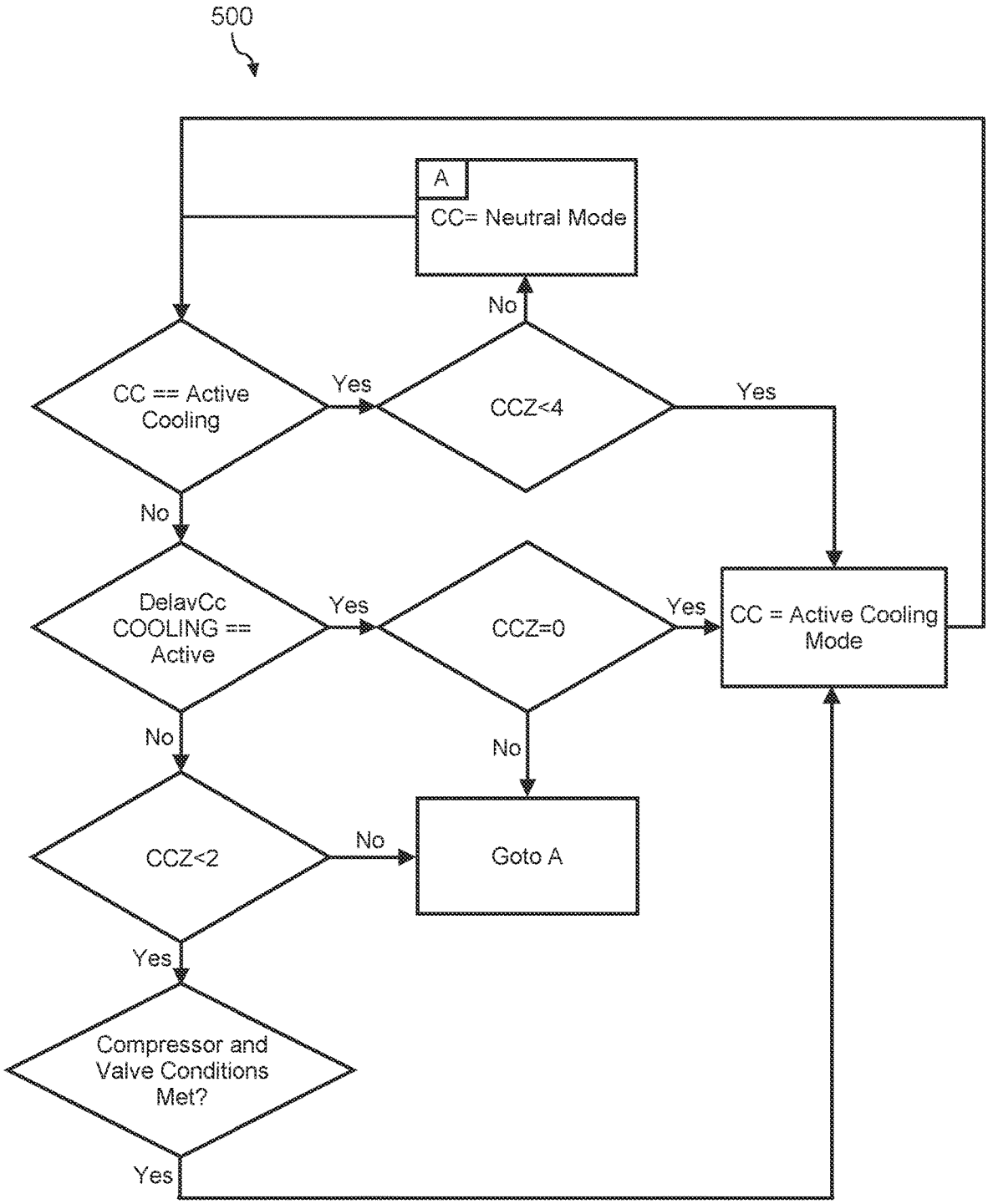
FIG. 5 provides an exemplary decision tree in accordance with embodiments of a method for operating a three-compartment refrigeration appliance in accordance with aspects of the present disclosure.

FIG. 5 depicts an exemplary decision tree in accordance with embodiments of method 1000. FIG. 5 provides an exemplary decision tree 500 corresponding to operation of the third compartment (Convertible Compartment or CC). Embodiments of the decision tree 500 may be executed in regard to determining whether CC cooling is satisfied, such as depicted in regard to decision tree 400 and method 1000 (e.g., at step 1030). Method 1000 may include determining whether Convertible Compartment (CC) Cooling (e.g., third compartment 103) is active (e.g., step 1030). Method 1000 may include comparing the third temperature (i.e., temperature at the convertible compartment, such as third compartment 103), such as may be obtained from the third temperature signal, to a CC zone to determine CC cooling is activated (e.g., CC=Active Cooling Mode). For instance, grid 700 depicts CC zones and control blocks including algorithms, control steps, commands, or sequences as may occur based on CC temperature. In an exemplary embodiment of method 1000, decision tree 500 determines whether the CC zone (e.g., CC temperature) is below a first threshold CC zone (CCZ), such as CC zone 4. CC Active Cooling may continue or commence if the CCZ is below the first threshold CCZ (such as CC zone 4), which may correspond to the CC having an insufficiently low temperature or relatively warm temperature. CC Cooling may enter a Neutral Mode if the CC zone is at or above the first threshold CCZ.

Determining whether CC cooling delay is active (e.g., Delay CC Cooling ACTIVE) may include determining whether a temperature override is active that may allow for the third compartment to cool prior to the first or second compartment temperatures being satisfied. For instance, a normal or nominal state may include Delay CC Cooling preventing cooling at the third compartment prior to first compartment cooling and second compartment cooling being satisfied (e.g., steps 1012, 1020). Accordingly, method 1000, such as at 1030 or 1032 may include comparing the third compartment temperature to a control grid (e.g., grid 700) to determine a control action. In an exemplary embodiment, decision tree 500 determines whether the CC zone (e.g., CC temperature) is at a second threshold CCZ, such as CC zone 0. For instance, as described in regard to grid 700, CCZ 0 corresponds to a temperature greater than a CC High Dead Band threshold. Accordingly, at or above the threshold (e.g., high CC temperature) leads to CC Active Cooling Mode (e.g., active cooling by the cooling system 105 at the third compartment 103). CC Cooling may enter a Neutral Mode if the CC zone is at or above the second threshold CCZ.

Method 1000 may include at 1032 determining whether the CC zone (e.g., CC temperature) is at or less than a third threshold CCZ (e.g., CCZ 2 or less) and whether cooling system conditions are met (e.g., compressor, valve, damper, or other operational components). When the CC temperature is less than the third threshold (e.g., CC temperature above CC high hysteresis) and cooling system conditions are met, CC Active Cooling Mode is activated or commenced.

During an exemplary embodiment of operation of the appliance 100 and method 1000, a Convertible Compartment Cooling Delay state is determined. While the delay is active, the CC Active Cooling state will not be entered in CCZ 1 of the Convertible Compartment Control Grid (e.g., grid 700). For instance, the delay requires the first and second compartments to satisfy respective temperatures prior to cooling the third compartment. When CC Cooling Delay is inactive, the Convertible Compartment may enter Active Cooling per the Convertible Compartment Control Grid (e.g., grid 700). For instance, the CC (e.g., third compartment 103) will enter Active Cooling in CCZ 0 regardless of CC Cooling Delay state.

During an exemplary embodiment of operation of the appliance 100 and method 1000, a Convertible Compartment Cool Before Off state is determined (e.g., step 1030). While the Cool CC Before Off state is active, the CC will enter Active Cooling (e.g., cooling system 105 activated, such as including the compressor speed Comp CC Cool Speed, Valve B, and FZ Fan High Speed). Accordingly, the Convertible Compartment may cool prior to the cooling system 105 (e.g., the compressor) turning off or deactivating following the Convertible Compartment Cooling Delay active state.

Embodiments of the appliance 100 and method 1000 may include FZ compartment (e.g., second compartment 102) temperatures having a relatively smaller range in contrast to methods cooling may be interrupted or stopped short of hysteresis lines. Embodiments may include a first compressor speed for active cooling (e.g., at the first compartment 101) and a second low compressor speed when the third compartment 103 (CC) begins Active Cooling, such as to match a FZ compartment (e.g., second compartment 102) warm-up rate when the compressor is off. The second compressor speed may generate a consistent bimodal grid and FZ compartment temperature. The CC may further benefit from the cooling system 105 including an evaporator at the FZ compartment already being cold when a damper opens.

Embodiments of the appliance 100 and method 1000 provided herein include serial control of compartment temperatures, such as to allow each compartment to be controlled by hysteresis lines rather than interaction from another compartment. Embodiments provided herein drive compartment cooling in serial operation, such as by prioritizing fresh food compartment cooling (e.g., first compartment) over freezer compartment cooling (e.g., second compartment), or furthermore over convertible compartment cooling (e.g., third compartment). Serial control of compartment temperature may drive temperature stability, generate repeatable (e.g., consistent and predictable) temperature cycles, and allow individual compartments to take priority if immediate cooling is required.

This written description uses examples to disclose the invention, including the best mode, and also to enable any person skilled in the art to practice the invention, including making and using any devices or systems and performing any incorporated methods. The patentable scope of the invention is defined by the claims, and may include other examples that occur to those skilled in the art. Such other examples are intended to be within the scope of the claims if they include structural elements that do not differ from the literal language of the claims, or if they include equivalent structural elements with insubstantial differences from the literal languages of the claims.

What is claimed is:

1. A refrigeration appliance, the refrigeration appliance comprising:

a cabinet defining a first compartment, a second compartment, and a third compartment each separately controllable to respective temperatures;

a cooling system configured to provided cooled air to a target temperature relative to each compartment; and a controller in operable communication with the cooling system to cause the cooling system to perform a cooling cycle, the operations of the cooling cycle comprising:

determining a third compartment cooling delay state, wherein an active delay state requires the first compartment to satisfy a first compartment temperature and requires the second compartment to satisfy a second compartment temperature prior to commanding the cooling system to provide third compartment cooling, and wherein an inactive delay state permits commanding the cooling system to provide third compartment cooling prior to satisfying the first compartment temperature or the second compartment temperature, wherein determining the third compartment cooling delay state as the inactive delay state is based on comparing a third compartment temperature to a plurality of cooling zones, wherein the third compartment temperature below a threshold corresponds to the inactive delay state and an insufficiently low temperature permitting a temperature override commanding the cooling system to provide third compartment cooling prior to satisfying the first and second compartment temperatures, and wherein the third compartment temperature above the threshold corresponds to the active delay state;

determining a third compartment cooling state, wherein determining the third compartment cooling state comprises comparing the third compartment temperature to the plurality of cooling zones to determine whether third compartment cooling is active or inactive;

when the third compartment cooling state is active and when the third compartment cooling delay state is in the inactive delay state, operating the cooling system to provide cooled air to the third compartment prior to satisfying the first and second compartment temperatures;

when the third compartment cooling delay state is in the active delay state, operating the cooling system to provide cooled air to the third compartment prior to deactivating the cooling system and following operating the cooling system to provide cooled air to the first compartment until a first compartment temperature is satisfied and operating the cooling system to provide cooled air to the second compartment until a second compartment temperature is satisfied.

2. The refrigeration appliance of claim 1, the operations comprising:

deactivating the cooling system to discontinue providing cooled air to the compartments after the second compartment temperature is satisfied and when the third compartment cooling state is inactive.

3. The refrigeration appliance of claim 1, the operations comprising:

deactivating the cooling system to discontinue providing cooled air to the compartments after the second compartment temperature is satisfied and after the third compartment temperature is satisfied.

4. The refrigeration appliance of claim 3, the operations comprising:

after deactivating the cooling system to discontinue providing cooled air to the compartments after the second compartment temperature is satisfied and after the third compartment temperature is satisfied, operating the cooling system to provide cooled air to the first compartment in higher priority than the second compartment.

5. The refrigeration appliance of claim 1, wherein the first compartment is a fresh food compartment, wherein the second compartment is a freezer compartment, and wherein the third compartment is a convertible compartment.

6. The refrigeration appliance of claim 1, wherein operating the cooling system to provide cooled air to the first compartment is in serial operation to operating the cooling system to provide cooled air to the second compartment.

7. The refrigeration appliance of claim 1, wherein operating the cooling system to provide cooled air to the first compartment continues until the first compartment temperature is satisfied.

8. A method for operating a three compartment refrigeration appliance, the method comprising:

determining a third compartment cooling delay state, wherein an active delay state requires a first compartment to satisfy a first compartment temperature and requires a second compartment to satisfy a second compartment temperature prior to commanding the cooling system to provide third compartment cooling, and wherein an inactive delay state permits commanding the cooling system to provide third compartment cooling prior to satisfying the first compartment temperature or the second compartment temperature, wherein determining the third compartment cooling delay state as the inactive delay state is based on comparing a third compartment temperature to a plurality of cooling zones, wherein the third compartment temperature below a threshold corresponds to the inactive delay state and an insufficiently low temperature permitting a temperature override commanding the cooling system to provide third compartment cooling prior to satisfying the first and second compartment temperatures, and wherein the third compartment temperature above the threshold corresponds to the active delay state;

determining a third compartment cooling state, wherein determining the third compartment cooling state comprises comparing the third compartment temperature to the plurality of cooling zones to determine whether third compartment cooling is active or inactive;

when the third compartment cooling state is active and when the third compartment cooling delay state is in the inactive delay state, operating the cooling system to provide cooled air to the third compartment prior to satisfying the first and second compartment temperatures; and when the third compartment cooling delay state is in the active delay state, operating the cooling system to provide cooled air to the third compartment prior to deactivating the cooling system and following operating the cooling system to provide cooled air to the first compartment until a first compartment temperature is satisfied and operating the cooling system to provide cooled air to the second compartment until a second compartment temperature is satisfied.

9. The method of claim 8, the method comprising:

deactivating the cooling system to discontinue providing cooled air to the compartments after the second compartment temperature is satisfied.

10. The method of claim 8, the method comprising:

deactivating the cooling system to discontinue providing cooled air to the compartments after the second compartment temperature is satisfied and after the third compartment temperature is satisfied.

11. The method of claim 10, the method comprising:

after deactivating the cooling system to discontinue providing cooled air to the compartments after the second compartment temperature is satisfied and after the third compartment temperature is satisfied, operating the cooling system to provide cooled air to the first compartment then operating the cooling system to provide cooled air to the second compartment.

12. The method of claim 8, wherein operating the cooling system to provide cooled air to the first compartment is in serial operation to operating the cooling system to provide cooled air to the second compartment.

13. The method of claim 8, wherein operating the cooling system to provide cooled air to the first compartment continues until the first compartment temperature is satisfied.

14. A controller for operating a refrigeration appliance, the controller configured to cause a cooling system of the refrigeration appliance to perform a cooling cycle, the operations comprising:

determining whether first compartment cooling is demanded;

determining a third compartment cooling delay state, wherein an active delay state requires a first compartment to satisfy a first compartment temperature and requires a second compartment to satisfy a second compartment temperature prior to commanding the cooling system to provide third compartment cooling, and wherein an inactive delay state permits commanding the cooling system to provide third compartment cooling prior to satisfying the first compartment temperature or the second compartment temperature, wherein determining the third compartment cooling delay state as the inactive delay state is based on comparing a third compartment temperature to a plurality of cooling zones, wherein the third compartment temperature below a threshold corresponds to the inactive delay state and an insufficiently low temperature permitting a temperature override commanding the cooling system to provide third compartment cooling prior to satisfying the first and second compartment temperatures, and wherein the third compartment temperature above the threshold corresponds to the active delay state;

when the third compartment cooling delay state is in the active delay state, commanding the cooling system to provide first compartment cooling when first compartment cooling is demanded and until the first compartment temperature is satisfied;

commanding the cooling system to provide second compartment cooling after the first compartment temperature is satisfied and until the second compartment temperature is satisfied;

determining a third compartment cooling state, wherein determining the third compartment cooling state comprises comparing the third compartment temperature to the plurality of cooling zones to determine whether third compartment cooling is active or inactive; and commanding the cooling system to provide cooled air to a third compartment when the third compartment cooling state is active and when the third compartment cooling delay state is in the inactive delay state.

15. The controller of claim 14, the operations comprising: commanding the cooling system to discontinue providing cooled air when the third compartment cooling state is inactive after the second compartment temperature is satisfied.

16. The controller of claim 14, the operations comprising: commanding the cooling system to discontinue providing cooled air after the second compartment temperature is satisfied and after the third compartment temperature is satisfied.

17. The controller of claim 14, the operations comprising: commanding operation of the cooling system to provide cooled air to the first compartment after commanding the cooling system to discontinue providing cooled air to the compartments after the second compartment temperature is satisfied and after the third compartment temperature is satisfied.

18. The controller of claim 14, wherein the first compartment corresponds to a first target temperature greater than a second target temperature corresponding to the second compartment, and wherein the third compartment corresponds to a third target temperature separate from the first and second target temperatures.

19. The controller of claim 14, wherein commanding the cooling system to provide cooled air to the third compartment comprises commanding the cooling system to provide cooled air to the third compartment after the second compartment temperature is satisfied and when the third compartment cooling state is active.

20. The controller of claim 14, the operations comprising: determining whether the third compartment temperature is less than the threshold to determine whether the third compartment cooling delay state is active.

* * * * *